US006955127B2

(12) United States Patent
Taylor

(10) Patent No.: US 6,955,127 B2
(45) Date of Patent: Oct. 18, 2005

(54) MANUAL RAILROAD HOPPER CAR DOOR ACTUATING MECHANISM

(76) Inventor: Fred J. Taylor, 6485 Rogers La., Burlington, KY (US) 41005

( * ) Notice: Subject to any disclaimer, the term of this patent is extended or adjusted under 35 U.S.C. 154(b) by 0 days.

(21) Appl. No.: 10/770,136

(22) Filed: Feb. 2, 2004

(65) Prior Publication Data

US 2004/0149163 A1 Aug. 5, 2004

Related U.S. Application Data

(60) Provisional application No. 60/444,598, filed on Feb. 3, 2003.

(51) Int. Cl.[7] ..... B61D 7/00
(52) U.S. Cl. ..... 105/299
(58) Field of Search ..... 105/286, 287, 105/288, 289, 290, 293, 296, 298, 299, 304; 403/48, 296

(56) References Cited

U.S. PATENT DOCUMENTS

| | | | | | |
|---|---|---|---|---|---|
| 248,193 | A | * | 10/1881 | Merriman | 403/48 |
| 1,368,372 | A | * | 2/1921 | Test | 105/290 |
| 3,137,247 | A | * | 6/1964 | Hamilton et al. | 105/251 |
| 3,187,684 | A | | 6/1965 | Ortner | |
| 3,596,609 | A | | 8/1971 | Ortner et al. | |
| 3,608,500 | A | * | 9/1971 | Floehr | 105/240 |
| 3,611,947 | A | | 10/1971 | Nagy | |
| 3,730,106 | A | * | 5/1973 | Tamborski | 105/253 |
| 3,786,764 | A | | 1/1974 | Beers, Jr. et al. | |
| 3,815,514 | A | | 6/1974 | Heap | |
| 3,918,842 | A | | 6/1974 | Heap | |
| 3,949,681 | A | | 4/1976 | Miller | |
| 4,222,334 | A | | 9/1980 | Peterson | |
| 4,224,877 | A | | 9/1980 | Stark et al. | |
| 4,366,757 | A | * | 1/1983 | Funk | 105/248 |
| 4,601,244 | A | | 7/1986 | Fischer | |
| 5,249,531 | A | | 10/1993 | Taylor | |
| 6,019,049 | A | | 2/2000 | Gaydos et al. | |
| 6,405,658 | B1 | * | 6/2002 | Taylor | 105/286 |

* cited by examiner

*Primary Examiner*—Mark T. Le
(74) *Attorney, Agent, or Firm*—Jerrold J. Litzinger

(57) ABSTRACT

An actuating system for manually operating the doors of a railroad hopper car. An operating shaft having a handle is rigidly coupled to an actuating lever. A door opening lever, which is rotatably coupled to the actuating lever, is rotatably coupled to the door for a hopper chute. To operate the system, an operator rotates the handle of the operating shaft, rotating the actuating lever and the door opening lever, shifting the door from the closed to the open position.

20 Claims, 12 Drawing Sheets

MANUAL RAILROAD HOPPER CAR DOOR ACTUATING MECHANISM

CROSS REFERENCE TO RELATED APPLICATIONS

This application claims benefit from U.S. Provisional Patent Application Ser. No. 60/444,598, filed Feb. 3, 2003, which application is incorporated herein by reference.

BACKGROUND OF THE INVENTION

1. Field of the Invention

The present invention relates generally to an apparatus for opening the doors of a railroad hopper car, and, in particular, to a novel apparatus for manually opening the hopper doors on a railroad car.

2. Description of the Prior Art

A common type of railroad freight car in use today is the freight car of the type wherein the load is discharged through hoppers in the underside of the body. Such cars are generally referred to as hopper cars and are used to haul coal, phosphate and other commodities.

After hopper cars are spotted over an unloading pit the doors of the hoppers are opened, allowing the material within the hopper to be emptied into the pit.

Hopper cars, which may be covered, are usually found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Prior art references which teach operating mechanisms for opening and closing hopper doors include U.S. Pat. Nos. 3,596,609; 4,741,274; 3,187,684; 3,611,947; 3,786,764; 3,815,514; 3,818,842; 3,949,681; 4,222,334; 4,366,757; 4,601,244; 5,823,118; and 5,249,531. There are several disadvantages to the hopper door operating mechanisms described in some of the aforementioned patents. One problem is that some of the prior art mechanisms are designed such that each actuating mechanism is connected to doors from two separate hoppers. Thus, if the mechanism fails, it effects the operation of two hoppers. Another disadvantage of some of the above described hopper door mechanisms is that the operating mechanisms limit the distance of the door motion, thus limiting the open area of the cars bottom. This arrangement slows the unloading process and causes additional costs and potential damage to the car due to increased periods in thaw sheds. A further disadvantage of some of the prior art hopper door mechanisms are that they are designed specifically for new railcar construction.

U.S. Pat. No. 6,405,158 is directed to a manual discharge door operating system for a hopper railcar. It includes a door actuation shaft coupled to the railcar extending across the width of the car. Rotation of the actuation shaft by the operator opens and closes the discharge door of the hopper railcar through linkage assemblies which are affixed to the center sill of the car. The linkage assemblies form an over-center latch to aid in maintaining the door in the closed position.

While the mechanism taught in the '658 patent works well, it must be mounted to the center sill of the railcar. In addition, it is designed to operate a door of a hopper chute having a certain fixed slope angle.

SUMMARY OF THE INVENTION

It is therefore an object of the present invention to provide a manual mechanism for actuating the discharge doors of a hopper car which can be used on cars with or without a center sill.

It is a further object of the present invention to provide a manual actuating mechanism of simple design for hopper car doors which can be used in new car manufacturing as well as can be retrofitted to existing cars.

It is a still further object of the present invention to provide an actuating mechanism for a hopper car which can be adjusted to operate doors of hopper chutes of varying slope angles.

It is a still further object of the present invention to provide an actuating mechanism for hopper car doors in which each door assembly has a positive over-center locking feature to securely close the doors in addition to a second safety latch.

These and other objects of the present invention will be more readily apparent from the descriptions and drawings which follow.

DESCRIPTION OF A PREFERRED EMBODIMENT

Figure 1:
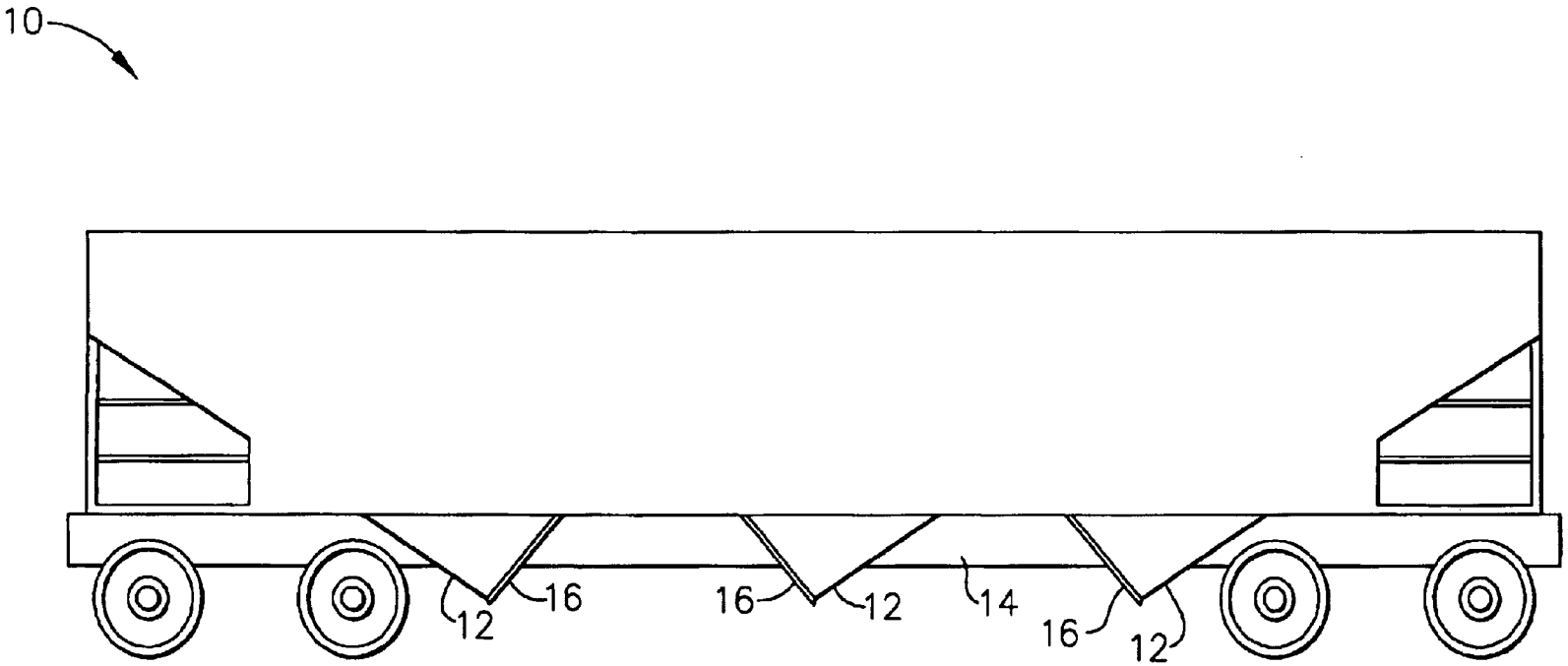
FIG. 1 is an elevational view of a standard three pocket hopper car onto which the door actuating mechanism of the present invention may be incorporated.

Referring now to FIG. 1, there is shown a typical three pocket railway hopper car, generally designated at 10, which may be equipped with a preferred embodiment of the present invention. Car 10 is provided with a plurality of hopper units 12 and a longitudinally extending center sill 14. Each hopper unit is provided with a door 16 which is moveable to open and close each hopper unit 12.

Figure 2:
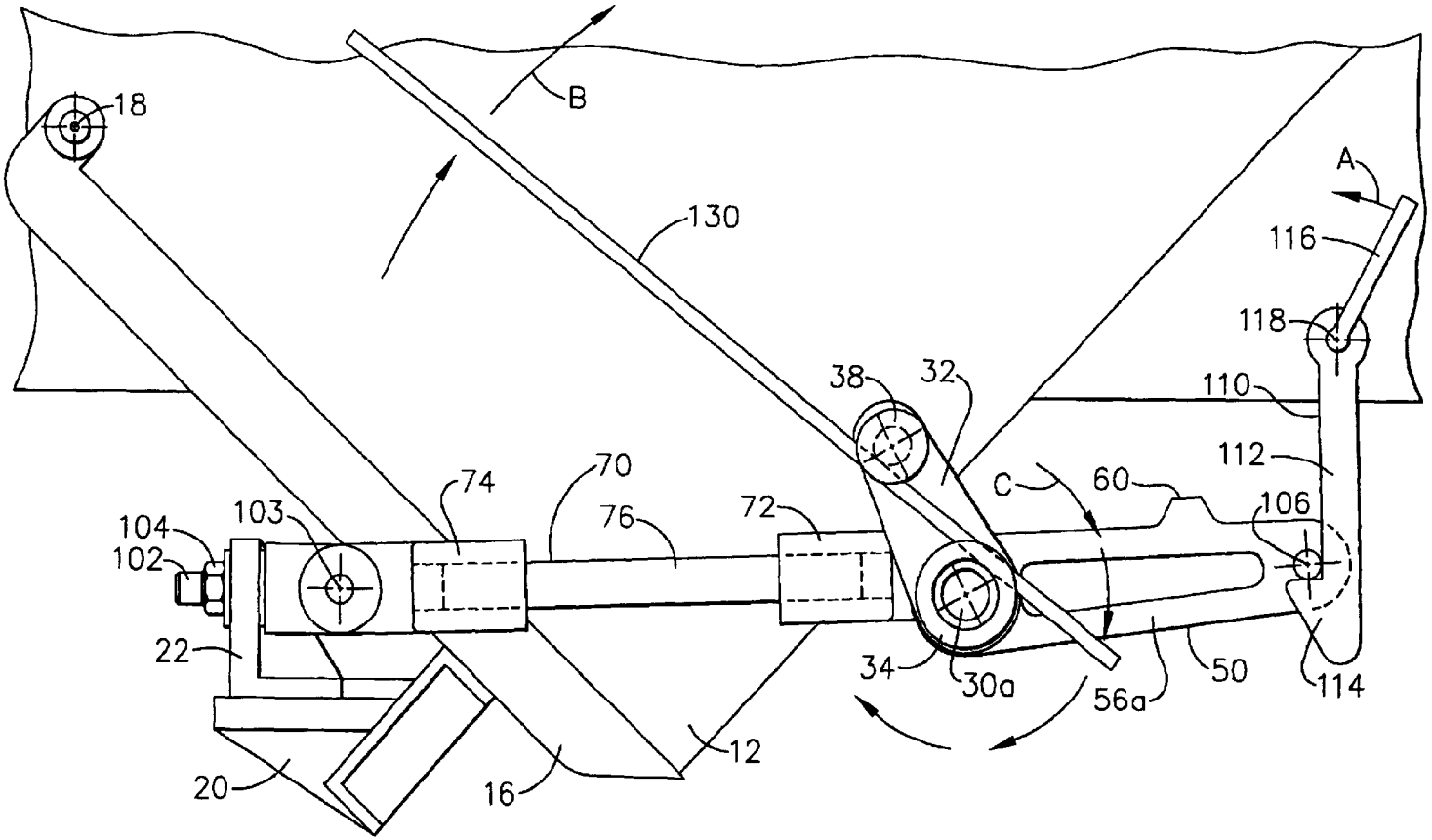
FIG. 2 is a side view of the actuating mechanism of the present invention shown in its closed position with a pry bar in position to open the hopper door.
Figure 3:
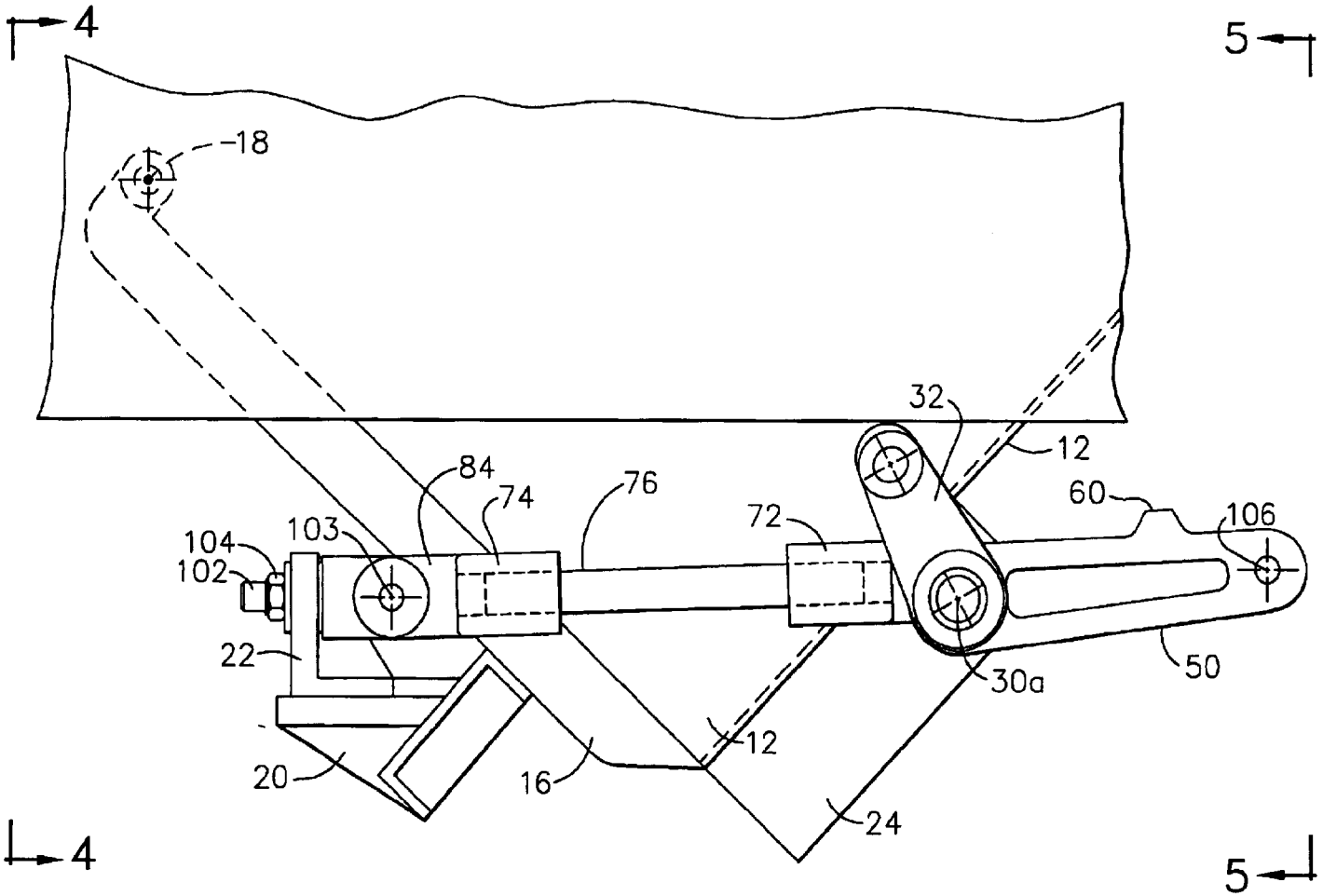
FIG. 3 is a side view of the mechanism of FIG. 2 with the pry bar removed.
Figure 4:
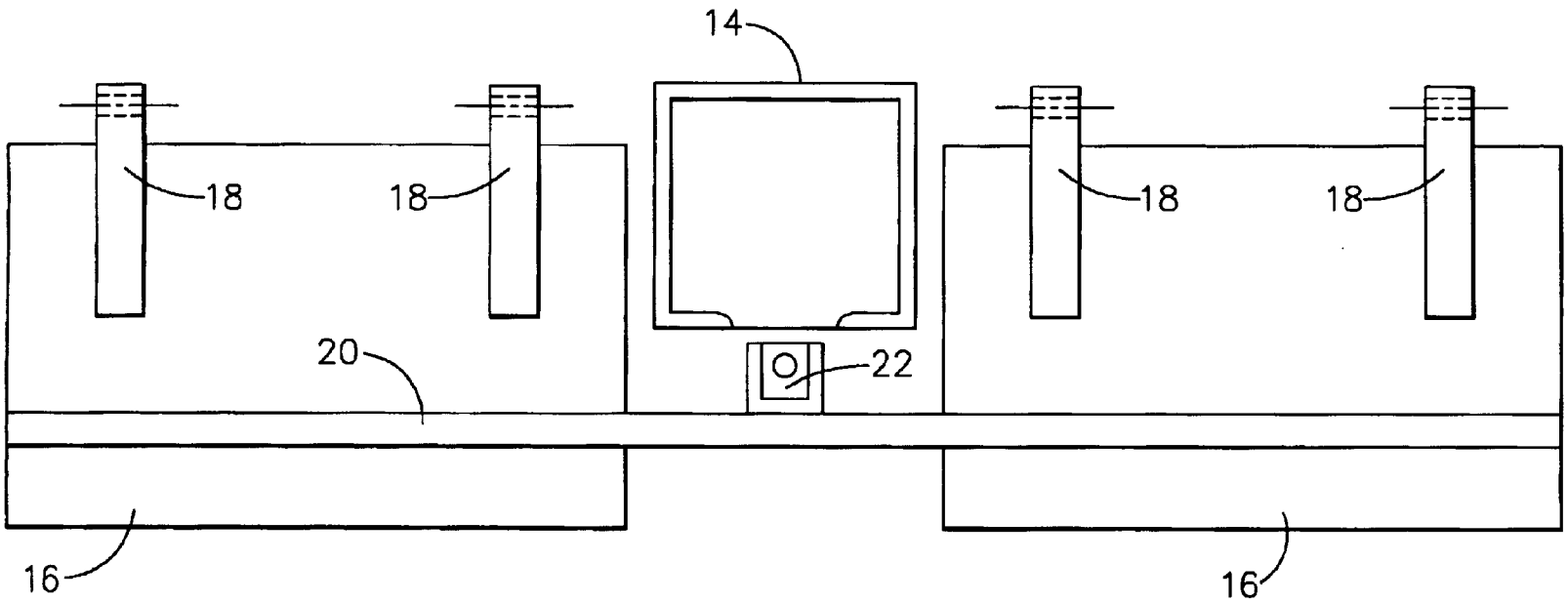
FIG. 4 is a sectional view taken along line 4—4 of FIG. 3.
Figure 5:
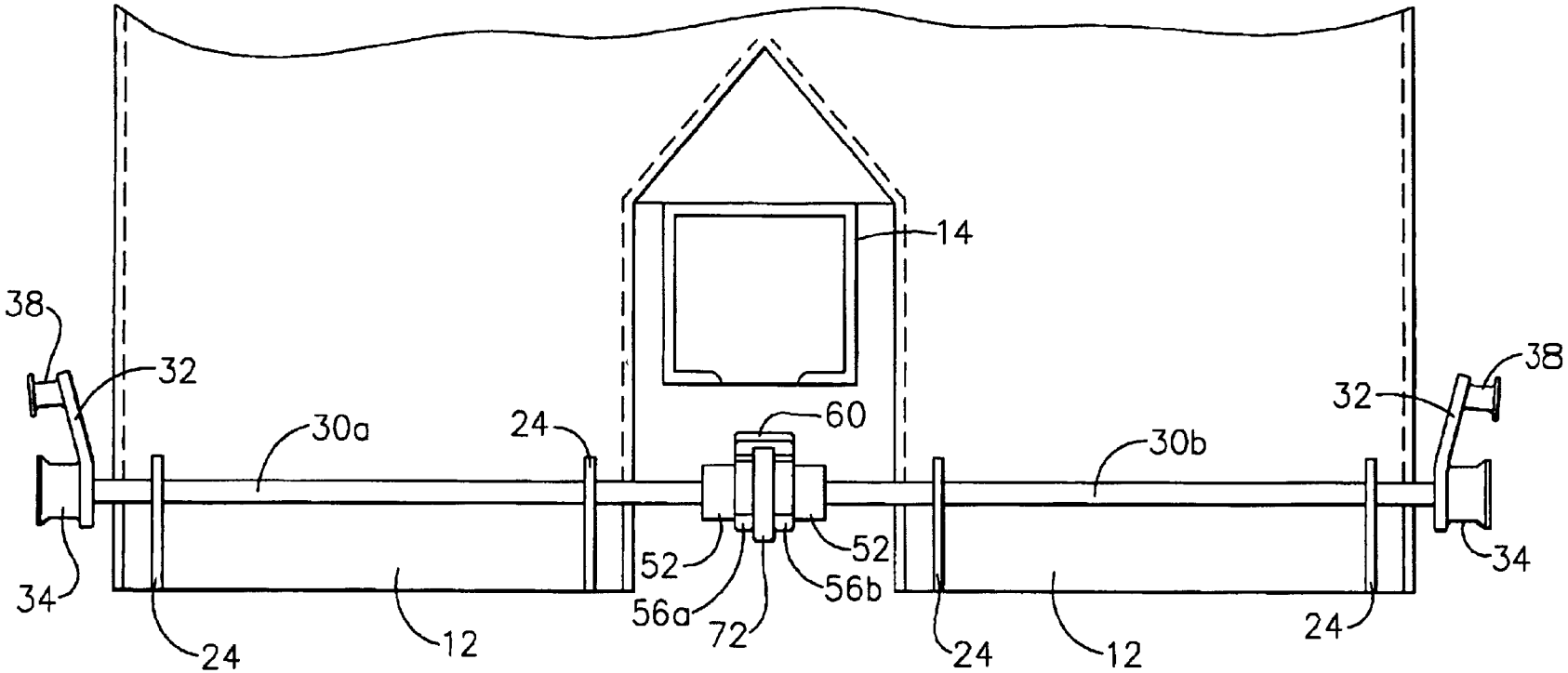
FIG. 5 is a sectional view taken along lines 5—5 of FIG. 3.

The mechanism of the present invention suited for use on railway hopper car 10 of FIG. 1 is most clearly shown in FIGS. 2 and 3. Door 16 is rotatably coupled to the underside of car 10 by a hinge 18 such that door 16 can be rotated from its closed position against hopper 12 to an open position allowing the contents of car 10 to be unloaded through hopper 12. A flange 20 is rigidly affixed to the outer surface of each door 16 such that flange 20 extends across car 10, as can be most clearly seen in FIG. 4. A coupling bracket 22 is affixed to flange 20 between doors 16. On the outer surface of each hopper 12, a plurality of extensions 24 are affixed at intervals (FIG. 5). A pair of operating shafts 30*a*, 30*b* extend across car 10 from each side through each extension 24 and are rotatably coupled within each extension 24. Attached to each of shafts 30*a*, 30*b* on each end is a handle 32. Each of the handles 32 contain a first boss 34 at one end having a through hole 36 for receiving the shaft, a second boss 38 located at its other end, and an angular section 40 coupling bosses 34 and 38. Shafts 30*a*, 30*b* are rigidly affixed within hole 36 of handle 32 by welding or the like.

Also rigidly affixed to each of shafts 30*a*, 30*b* is a main actuating lever 50. Lever 50, which in the present embodiment is located between hoppers 12, contains at one end a pair of outwardly extending cylindrical extensions 52 each having a bore 54, and a bifurcated body section 56 connected to extensions 52, having sections 56*a* and 56*b*, which contains a pair of apertures 58 within sections 56*a* and 56*b* at its end opposite extensions 52. Actuating lever 50 also contains a pair of stops 60 which extend across bifurcated body section 56. Shafts 30*a*, 30*b* are fixed within bores 54 by welding or any similar process.

An opening lever 70 couples doors 16 to actuating lever 50. Lever 70 consists of a first section 72, which is rotatably coupled to actuating lever 50 between bifurcated sections 56*a*, 56*b*, a second section 74, which affixed to coupling bracket 22, and an intermediate section 76 which connects first section 72 and second section 74. First section 72 consists of an elongated flat portion 77 having a through hole 78 at one end and a cylindrical section 80 at its opposite end. Cylindrical section 80 includes a bore 82. Second section 74 consists of a flat section 84 having a through hole 86 at one end and a cylindrical section 88 at its opposite end. Cylindrical section 88 includes a bore 90. Intermediate section 76 consists of a tubular element which is rigidly affixed within bores 82, 90 of sections 72, 74 respectively.

Second section 74 is attached to coupling bracket 22 by a clevis 100. Clevis 100 consists of a pair of bifurcated arms 100*a*, 100*b* having through holes 101 at one end, and a threaded extension 102 at its opposite end. Clevis 100 is rotatably coupled to section 84 of opening lever 70 between bifurcated arms 100*a*, 100*b* by a pin 103 passing through holes 86 and 101, and is rigidly fixed to bracket 22 by a nut 104 which is threaded onto extension 102 of clevis 100. First section 72 is rotatably coupled between bifurcated sections 56*a*, 56*b* of body section 56 of lever 50 by a pin 106 passing through apertures 58.

A secondary locking mechanism 110 is pivotally mounted on the underside of car 10 to add a positive locking safety to the actuating mechanism of the present invention. Locking mechanism 110 consists of an elongated member 112 having a hook-like protrusion 114 at one end, and a lever 116 fixed to its opposite end. Protrusion 114 is shaped to engage first section 72 of opening lever 70 when the actuating mechanism is in the closed position. To operate locking mechanism 110, lever 116 is shifted in the direction shown by arrow A, causing member 112 to rotate about a pivot pin 118, forcing protrusion 114 away from and out of engagement with section 72. Locking mechanism 110 may be spring biased to keep protrusion 14 in the locked position unless lever 116 is shifted in the direction shown by arrow A.

When door 16 is in the closed position covering hopper 12, operating lever 70 is located between bifurcated sections 56*a*, 56*b* of body section 56 such that it contacts the underside of stops 60 of actuating lever 50. In this position, pin 106 which couples levers 50 and 70 together is located above the horizontal plane through the center of shafts 30*a*, 30*b*, maintaining an over-center closed configuration for the mechanism. In the current embodiment, pin 106 is 3 degrees over center in the closed position. Stops 60 act to prevent lever 50 from travelling too far over center.

The operation of the door actuating mechanism of the present invention will now be described as follows. Referring again to FIG. 2, a pry bar 130 is used to activate the mechanism. Pry bar 130 is positioned between bosses 34 and 38 of handle 32 as shown. After locking mechanism 110 has been released, pry bar 130 is rotated in the clockwise direction as shown by arrows B. This action causes handle 32, along with shafts 30*a*, 30*b* which are each fixed within hole 36 of respective handles 32, to rotate in the clockwise direction as shown by arrows C.

Figure 6:
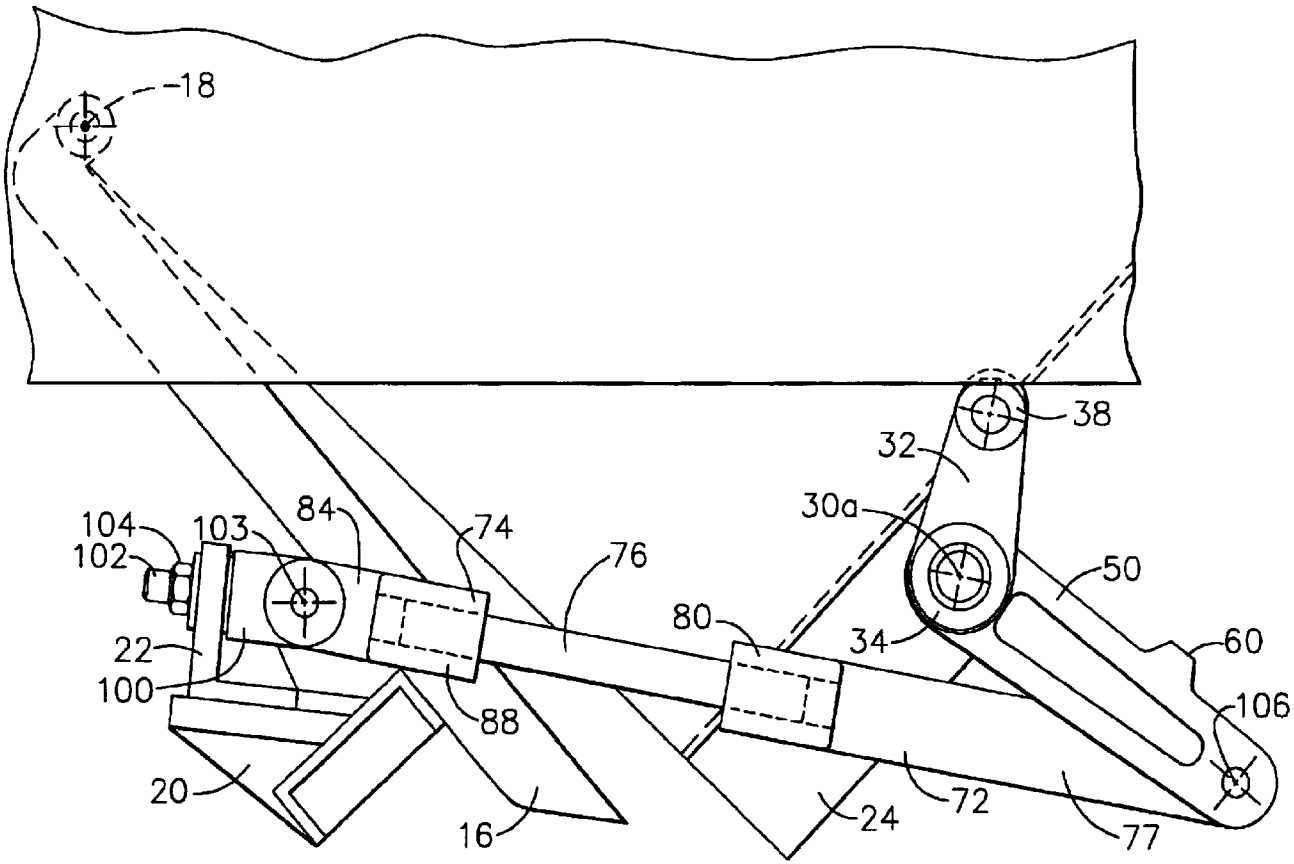
FIG. 6 is a side view of the mechanism of FIG. 3 in which the door has begun the opening operation.
Figure 7:
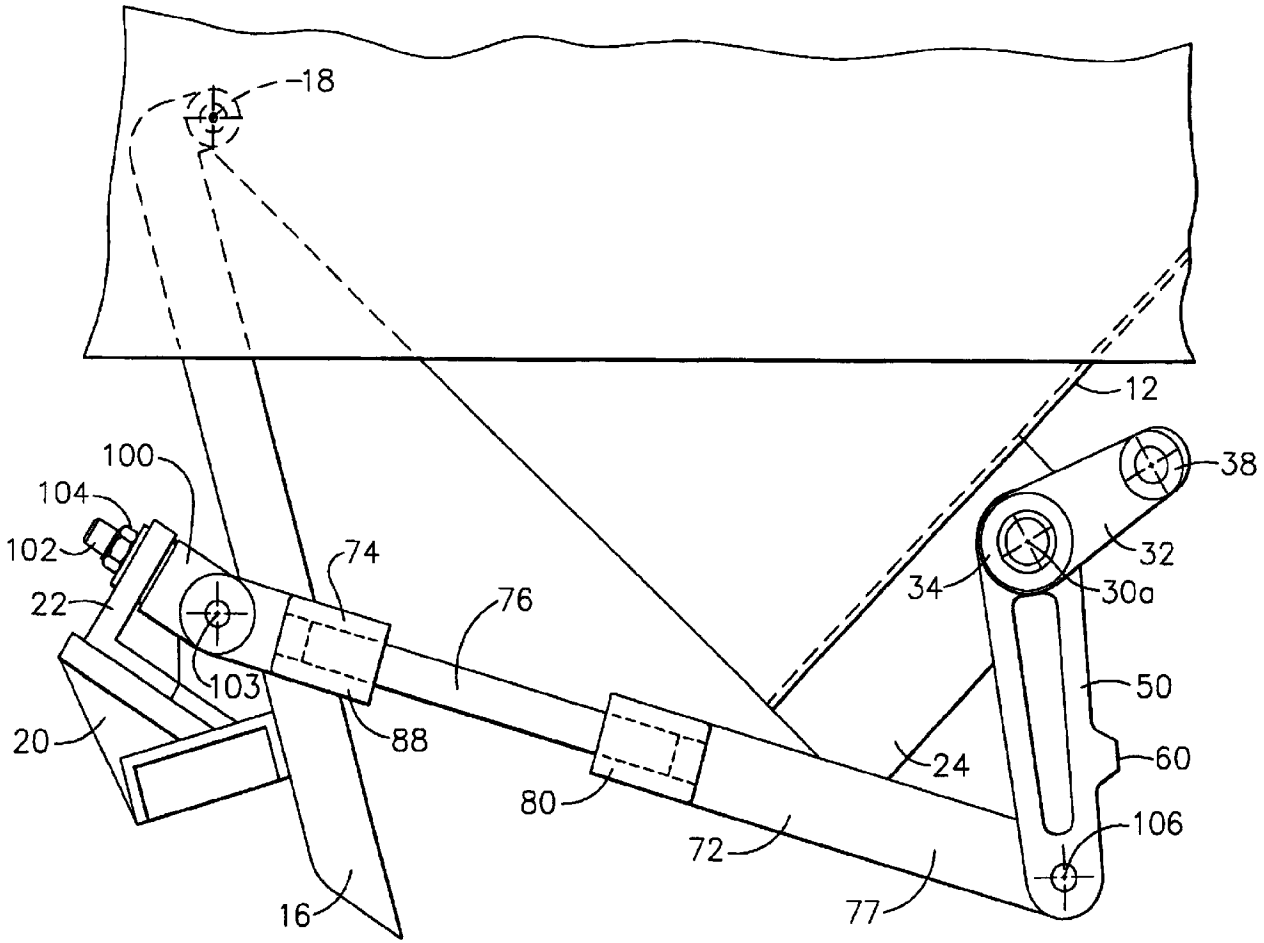
FIG. 7 is a side view of the mechanism of FIG. 3 in which the door is travelling to its opening position.
Figure 8:
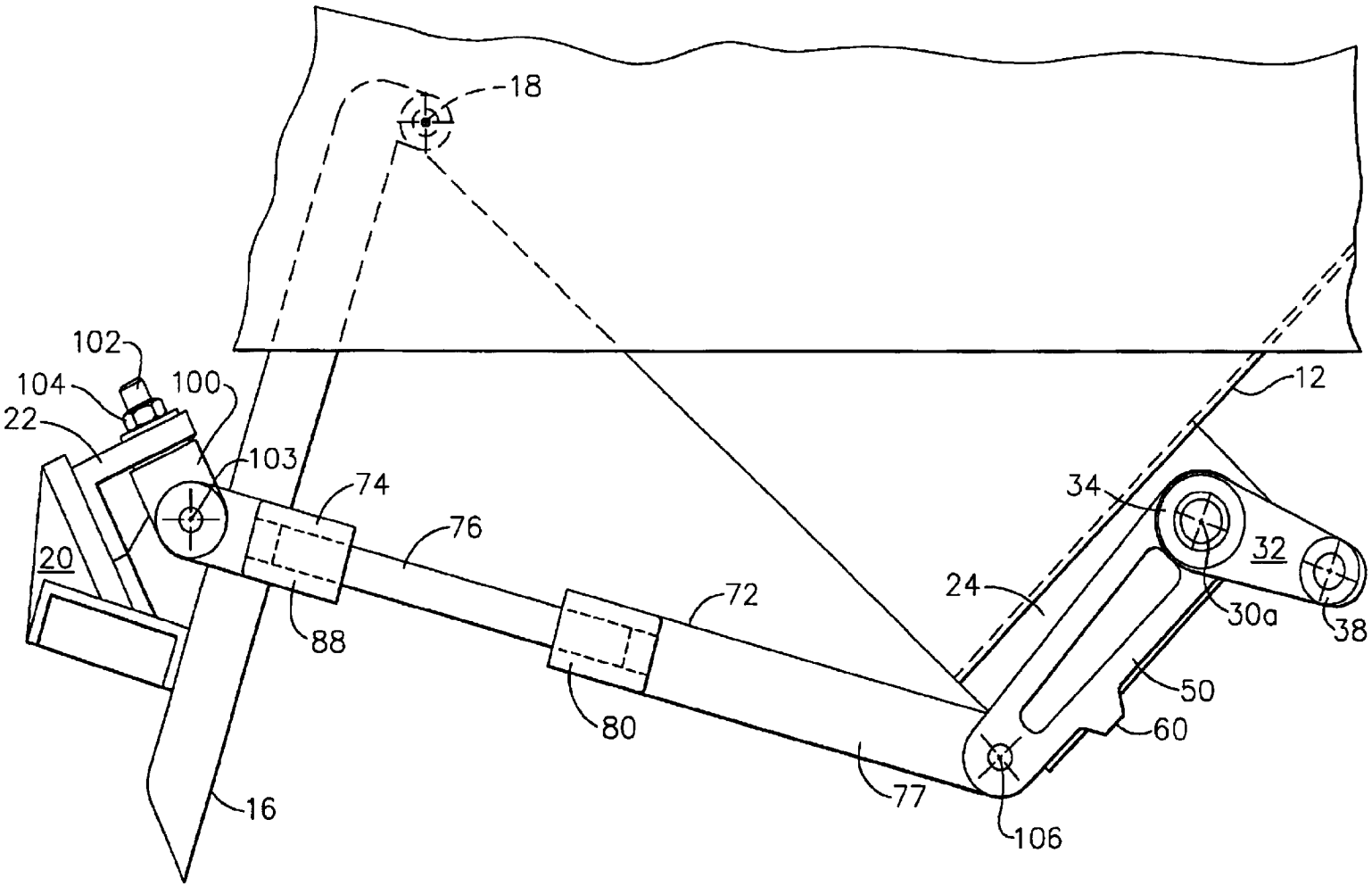
FIG. 8 is a side view of the mechanism of FIG. 3 in which the door has moved to its fully open position.
Figure 9A:
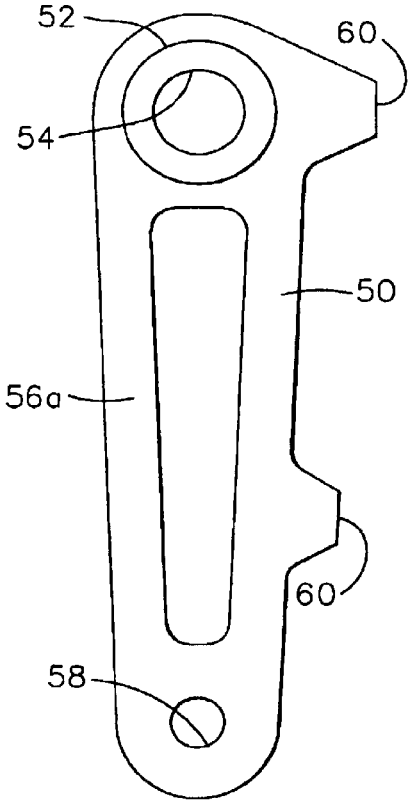
FIGS. 9A–C show the main actuating lever of the present invention.
Figure 9B:
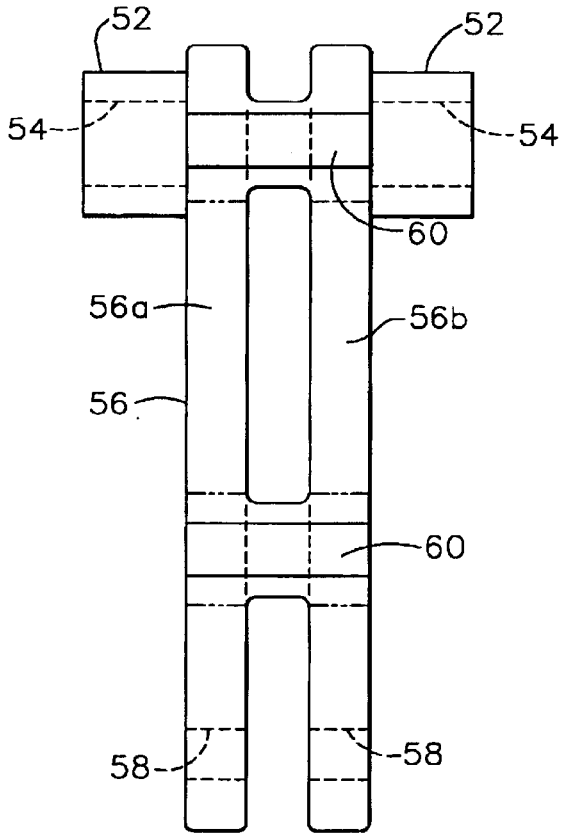
Figure 9C:
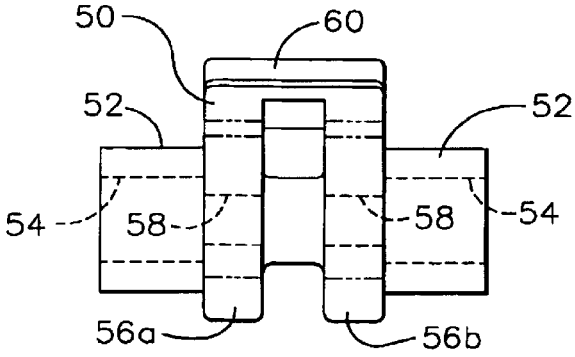
Figure 11A:
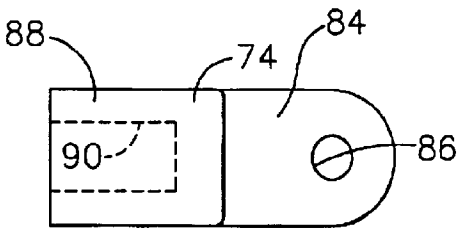
FIGS. 11A–B show a second section of the door coupling link of the present invention.
Figure 11B:
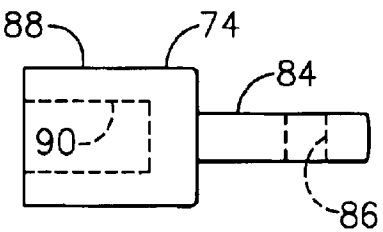
Figure 10B:
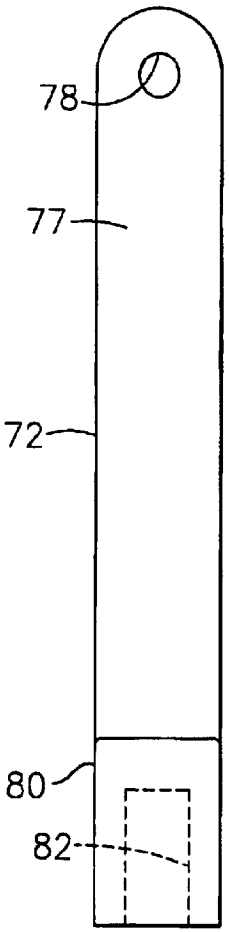
FIGS. 10A–B show a first section of the door coupling link of the present invention.
Figure 10A:
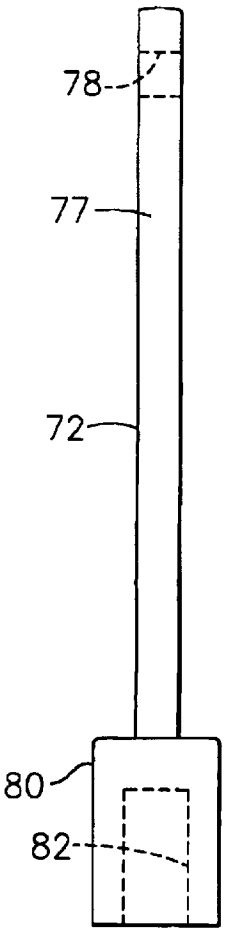
Figure 13B:
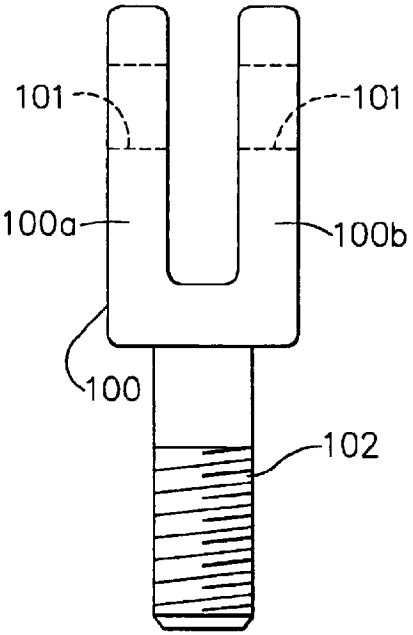
FIGS. 13A–B show the clevis of the present invention.
Figure 13A:
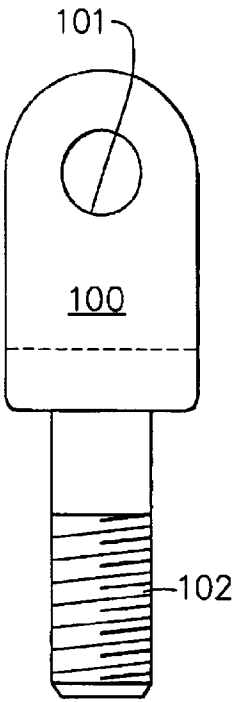
Figure 12B:
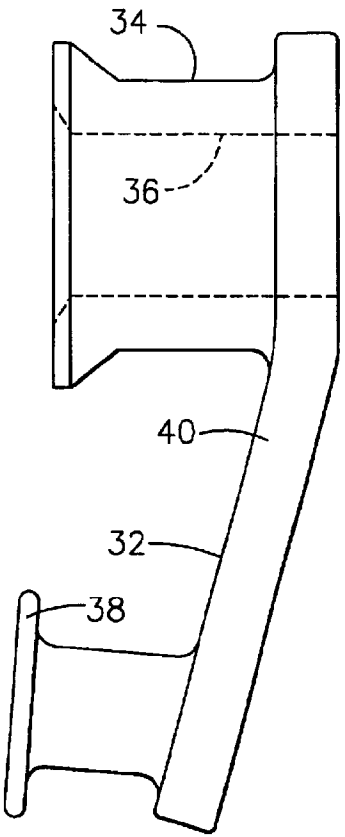
FIGS. 12A–B show the operating handle of the present invention.
Figure 12A:
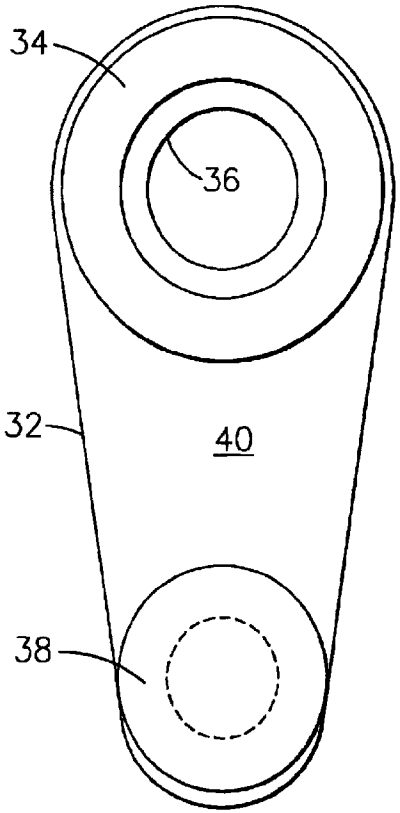

As handle 32 continues to rotate, main actuating lever 50, which is rigidly affixed to handles 32 and shafts 30*a*, 30*b*, also rotates, as can be clearly seen in FIG. 6. This rotation causes pin 106 to pass through the horizontal plane through the center of shafts 30*a*, 30*b* releasing the over-center latch feature of the mechanism. Continued rotation of handle 32 causes lever 70 to exert a force on door 16, as lever 70 is coupled for rotation to actuating lever 50 by pin 106. Further rotation of handle 32 causes gradual rotation of door 16 about hinge 18 as shown in FIGS. 6 and 7 until hopper 12 is completely open, as door 16 has travelled to its outermost open position (FIG. 8).

To close door 16, handle 32 is rotated in the opposite direction. As pin 106 crosses the horizontal plane through the center of shafts 30*a*, 30*b*, the positive over-center latching action of the mechanism is accomplished. In addition, as pin 106 contacts protrusion 114 of locking mechanism 110, elongated member 112 is cammed away from lever 50. Further travel of pin 106 causes hook-like protrusion 114 to engage pin 106 in the locked position of door 16, adding an additional safety measure for the actuating mechanism.

As the mechanism of the present invention has a handle on either side of car 10, it can be operated from either side of the car by a single operator. In addition, as this mechanism is mounted to the hopper frame as opposed to the center sill, like prior art mechanisms; thus, this invention may be installed on cars with center sills, cars without center sills, cars with cz center sills, cars with csc center sills, and cars with full closed (tube) center sills. The mechanism can also be installed on cars with bottom mounted brake rigging without moving the brake rigging. In addition, if the doors of the railcar open in the opposite direction than the door shown in FIGS. 2–8, the mechanisms would be a mirror image of the mechanism taught in the drawings.

Figure 14:
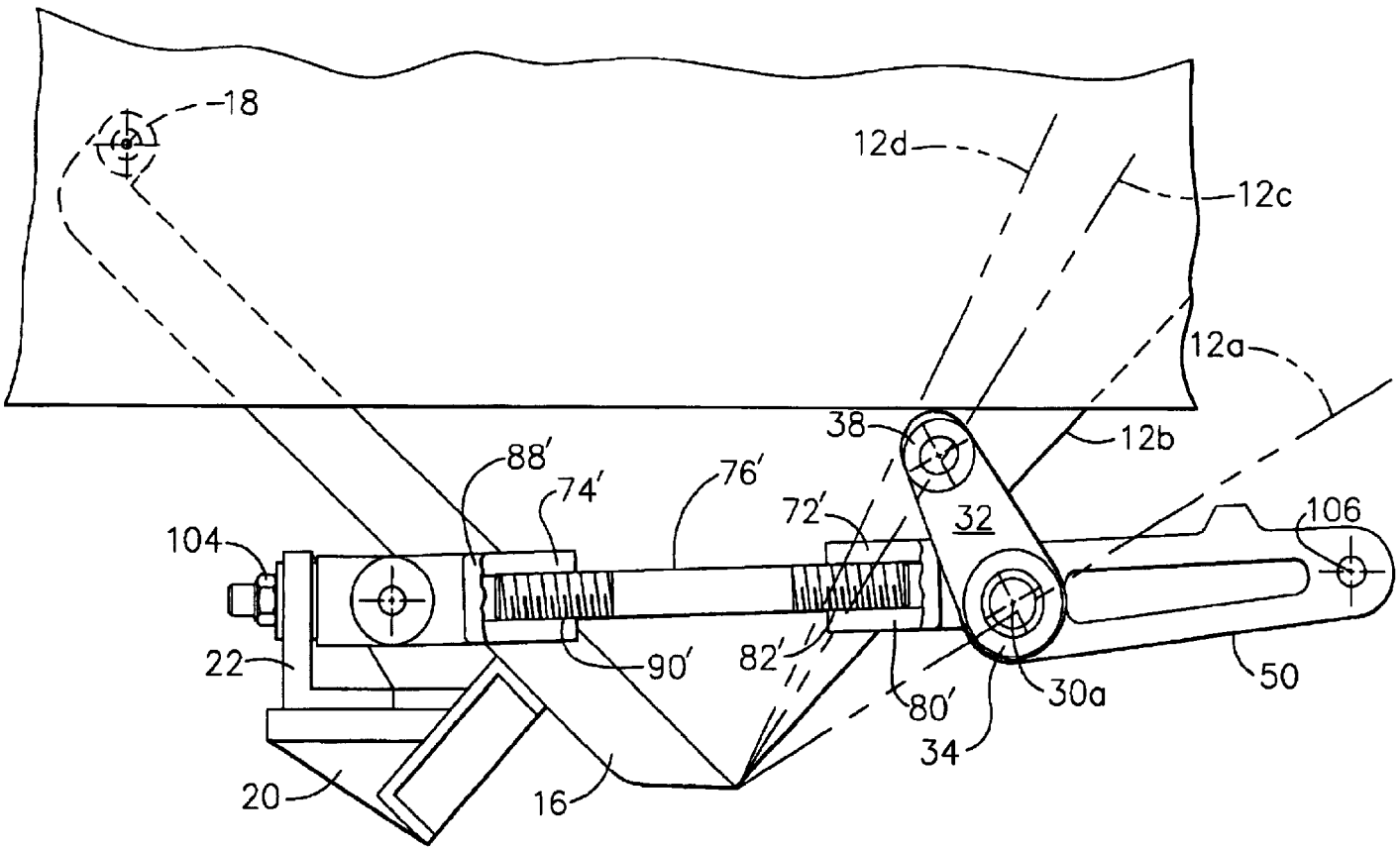
FIG. 14 is a side view of the mechanism of the present invention showing several different chute angles that are possible on hopper units.

The mechanism of the present invention is easily adaptable to hopper chutes of different angles. Referring now to FIG. 14, there is shown in phantom a series of hopper chutes having different slope angles. Hopper 12*a* shows a 30 degree chute; hopper 12*b* shows a 45 degree chute, hopper 12*c* shows a 55 degree chute; and hopper 12*d* shows a 60 degree chute. To compensate for the different chute angles contemplated on railcars, it is only necessary to lengthen or shorten opening lever 70' to compensate for the different chutes. Lever 70' consists of first section 72', intermediate section 76', and second section 74'.

To adjust opening lever 70' for a different slope angle for the hopper, intermediate section 76' is removed and a different section 76' is fitted between sections 72' and 74' to accommodate the distance between coupling bracket 22 and pin 106. When the appropriate length of intermediate section 76' is selected, nut 104 is tightened onto threaded section 102 of clevis 100 to properly tension opening lever 70' for operating the actuating mechanism.

An alternate embodiment for opening lever 70' can also be used for different chute angles. In this embodiment, bore 82' of section 72' and bore 90' of section 74' contain internal threads, while intermediate section 76' includes externally threaded sections at each end. To adjust lever 70' for different slope angles for the hopper, it is only necessary to adjust the length of intermediate section 76' by adjusting the threaded bores 82', 90' onto section 76' to achieve the proper length, and then tightening nut 104 onto threaded section 102 of clevis 100 to the proper tension.

In the above description, and in the claims which follow, the use of such words as "clockwise", "counterclockwise", "distal", "proximal", "forward", "rearward", "vertical", "horizontal", and the like is in conjunction with the drawings for purposes of clarity. As will be understood by one skilled in the art, the mechanisms will operate on hopper doors which open in opposite directions, and thus will use opposite terminology.

While the invention has been shown and described in terms of a preferred embodiment, it will be understood that this invention is not limited to this particular embodiment and that many changes and modifications may be made without departing from the true spirit and scope of the invention as defined in the appended claims.

What is claimed is:

1. A manual operating mechanism for actuating doors of a hopper car including a body having an underside, at least one discharge chute having an underside positioned along the underside of the body, and at least one door coupled for rotation to the body to open and close each discharge chute, said mechanism comprising:

a door opening lever rotatably coupled at its first end directly to said at least one door for shifting said at least one door between a first chute closed position and a second chute open position;

an actuating lever, rotatably coupled to said door opening lever at its second end;

and a first operating shaft, coupled for rotation to the underside of said at least one chute, rigidly affixed at a first end to said actuating lever and having a first handle rigidly affixed at a second end on a first lateral side of said car, whereby when said first handle is manually rotated by an operator, said first operating shaft rotates said actuating lever to cause said door opening lever to shift said at least one door from said first chute closed position to said second chute open position.

2. The mechanism of claim 1, wherein said actuating lever comprises:

a first cylindrical extension having a bore for receiving said first end of said first operating shaft, and a bifurcated body section connected to said first cylindrical extension, said body section having a pair of arms each containing an aperture for use with a first pin to rotatably couple said door opening lever between said arms.

3. The mechanism of claim 2, wherein when said at least one door is in the first chute closed position, said door operating lever is located between said arms of said bifurcated body section of said actuating lever.

4. The mechanism of claim 3, wherein said actuating lever and said door operating lever cooperate to maintain an over-center latch when said door is in said first chute closed position.

5. The mechanism of claim 3, wherein said actuating lever contains at least one stop means to contact said operating lever when said door is in said first chute closed position.

6. The mechanism of claim 1, further comprising:

a second operating shaft, coupled for rotation to the underside of at least one chute, rigidly affixed at a first end to said actuating lever and having a second handle rigidly affixed at a second lateral side of said car.

7. The mechanism of claim 1, wherein said first operating shaft is rotatably coupled to said underside of said at least one chute by at least one hopper extension.

8. The mechanism of claim 2, wherein said door opening lever comprises:

a first section containing a first aperture for use with said first pin to rotatably couple said door opening lever to said actuating lever;

a second section containing a second aperture for use with a second pin to rotatably couple said door opening lever to said at least one door;

and an intermediate section rigidly coupling said first section to said second section.

9. The mechanism of claim 8, wherein said first section contains a cylindrical section having an internally threaded first bore, said second section contains a cylindrical section having an internally threaded second bore, and said intermediate section consists of a tubular element having an externally threaded section at each end, such that the overall length of said door opening lever can be adjusted.

10. The mechanism of claim 1, further comprising an external locking means, rotatably coupled to the body of the hopper car, for holding said door opening lever when said at least one door is in the first chute closed position.

11. The mechanism of claim 1, wherein said first handle contains a first end having a first boss with a bore for rigidly affixing said first operating shaft to said first handle, and a second end having a second boss extending essentially parallel to said first boss.

12. The mechanism of claim 11, wherein said first and second bosses are positioned on said first handle such that a pry bar can be located between said first and second bosses to rotate said first operating shaft.

13. A manual operating system for actuating the door of a hopper of a railcar from a closed to an open position, comprising:

an operating shaft, coupled for rotation to the underside of said hopper, having a handle rigidly affixed to said shaft and engageable for rotation by an operator at one end;

an actuating lever, rigidly affixed at a first end to said operating shaft at its end opposite said handle, and having a bifurcated second end; and a door opening lever, rotatably coupled at its first end directly to the outer side of a hopper door and at its second end between said bifurcations of said second end of said actuating lever, wherein when said handle is rotated by the operator, said actuating lever rotates in the same direction as said handle, causing said door opening lever to shift the hopper door from its closed to its open position.

14. The system of claim 3, wherein said door opening lever comprises:

a first section containing a first aperture for rotatably coupling said door opening lever to said actuating lever;

a second section containing a second aperture for rotatably coupling said door opening lever to said hopper door;

and an intermediate section rigidly coupling said first section to said second section.

15. The system of claim 14, wherein said intermediate section is adjustable to adapt said door opening lever to accommodate hoppers having different slope angles.

16. The system of claim 13, wherein said door opening lever is positioned between the bifurcations of said second end of said actuating lever when said door is in the closed position.

17. The system of claim 16, wherein said actuating lever contains stop means for controlling said door opening lever when said door is in said closed position.

18. The system of claim 13, wherein said operating shaft is rotatably coupled to an extension affixed to the underside of said hopper.

19. A manual operating mechanism for actuating doors of a hopper car, said car including a body having an underside, a first lateral side and a second opposite lateral side, a pair of discharge chutes, each having an underside, arranged side by side in a transverse direction across the underside of the body, and a pair of doors, each having an inner surface and an outer surface and each coupled for rotation to the underside of the body, to open and close each discharge chute, said mechanism comprising:

a door opening lever, rotatably coupled at its first end directly to the pair of doors, for shifting each door between a first chute closed position and a second chute open position;

an actuating lever, rotatably coupled to said door opening lever at its second end, having a first end containing a first and a second cylindrical extension, with each extension containing a bore, and a bifurcated body section connected to said first end, said body section having a pair of arms each containing an aperture for use with a first pin to rotatably couple said door opening lever between said arms;

a first operating shaft, coupled for rotation to the underside of one of said discharge chutes, rigidly affixed at a first end within said bore of said first cylindrical extension of said actuating lever, and having a first handle rigidly affixed at a second end on a first lateral side of said car;

and a second operating shaft, coupled for rotation to the underside of the other of said discharge chutes, rigidly affixed at a first end within said bore of said second cylindrical extension of said actuating lever, and having a second handle rigidly affixed at a second end on a second lateral side of said car;

whereby when either said first handle or said second handle is manually rotated by an operator, said first and second operating shafts rotate said actuating lever to cause said door opening lever to shift said pair of doors from said first chute closed position to said second chute open position.

20. The mechanism of claim 19, further including a flange, affixed to the outer side of said doors, for directly coupling said doors to said door opening lever.

* * * * *